US005209362A

United States Patent [19]

Lutzker

[11] Patent Number: 5,209,362

[45] Date of Patent: May 11, 1993

[54] CAN RESEALER

[76] Inventor: Robert S. Lutzker, 10 Woodstone Ct., South Huntington, N.Y. 11746

[21] Appl. No.: 825,388

[22] Filed: Jan. 24, 1992

[51] Int. Cl.[5] ..... B65D 55/02

[52] U.S. Cl. ..... 215/225; 215/274; 220/729

[58] Field of Search ..... 215/225, 274, 277, 280, 215/221; 220/694, 729

[56] References Cited

U.S. PATENT DOCUMENTS 2,339,343 1/1944 Magnesen ..... 215/274
3,469,725 9/1969 Turner ..... 215/225
3,779,412 12/1973 Kirton ..... 215/225
3,893,582 7/1975 Kowalik ..... 215/221

*Primary Examiner*—Allan N. Shoap
*Assistant Examiner*—Nova Stucker
*Attorney, Agent, or Firm*—Kane, Dalsimer, Sullivan, Kurucz, Levy, Eisele and Richard

[57] ABSTRACT

A can top resealer includes a locking member with built in camming means and an inner latching cap member having downwardly depending fingers having inwardly extending lugs that engage with the can top to assume a latched position when the locking member is lowered. When the locking member is lowered the camming means urge the fingers inwardly to releasably lock the lugs about the can top. A gasket is included for purposes of completing a hermetic seal.

10 Claims, 4 Drawing Sheets

CAN RESEALER

BACKGROUND OF THE INVENTION

This application relates to can top sealing closures and more particularly to closures closing and sealing open partially consumed "pop-top" cans now generally refered to as "captive end" or "convenience opening" cans containing carbonated beverages or drinks.

Upon the opening of a can, whether by a can opener, retainer or removable tab or otherwise, a problem forever confronting the consumer, housewife or parent when the drink is only partially consumed, is preserving the vitality of the carbonated drink for later consumption. To date, many can sealers have been proposed, but none have attained any wide degree of success or commercial acceptance for a variety of reasons, mainly, the inability to have one closure that effectively seals all pop-top cans no matter how they may be opened or their opening formed. More often than not, the carbonation in the drink simply will escape through the opening in the can thereby leaving the drink "flat". As a result, the consumer is obliged to complete the drink perhaps against their wishes once the can has been opened, or waste the balance of product.

Earlier attempts at can resealers that have met with limited success are disclosed in U.S. Pat. Nos. 3,622,034, RE 27301 and 4,410,102.

SUMMARY OF THE INVENTION

It is therefore a principal object of this invention to provide a can resealer that may be applied to cans no matter how they are opened to preserve partially consumed liquids, beverages or drinks whether carbonated or not.

Another object is to provide a can resealer which may be used repeatedly, that is simple and rugged in construction and which is economical to manufacture, simple in operation and easy to use.

The several aforenoted objects and advantages among others will become apparent from the following detailed description which is to be taken in conjunction with the accompanying drawings.

DETAILED DESCRIPTION

Figure 1:
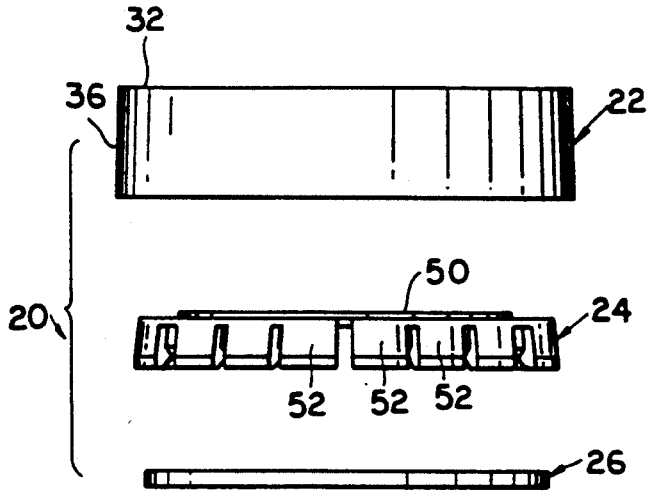
FIG. 1 is a exploded elevational view showing the three components of the resealable can closure of the present invention.
Figure 2:
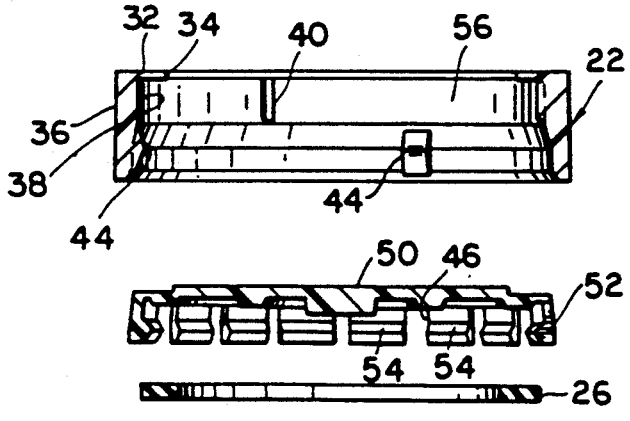
FIG. 2 is a similar exploded elevational view showing the parts of FIG. 1 in section.
Figure 3:
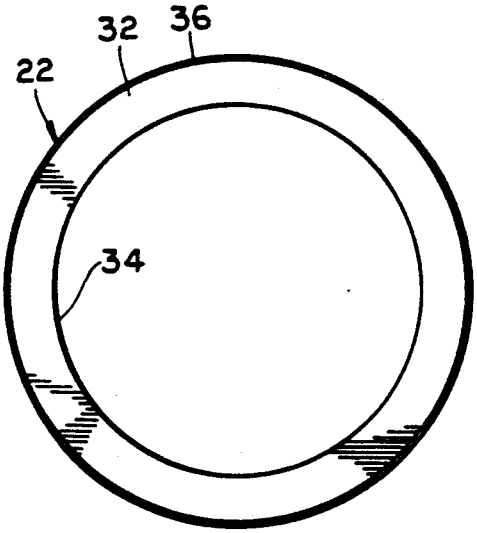
FIG. 3 is a top plan view of the outer annular circumferentially extending releasable locking member.
Figure 4:
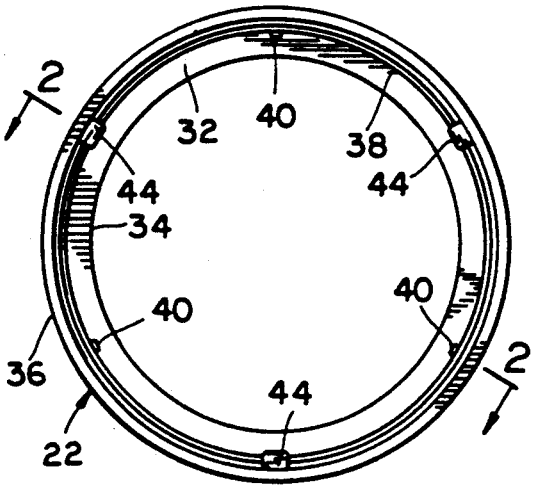
FIG. 4 is a bottom plan view of the locking member of FIG. 3.
Figure 5:
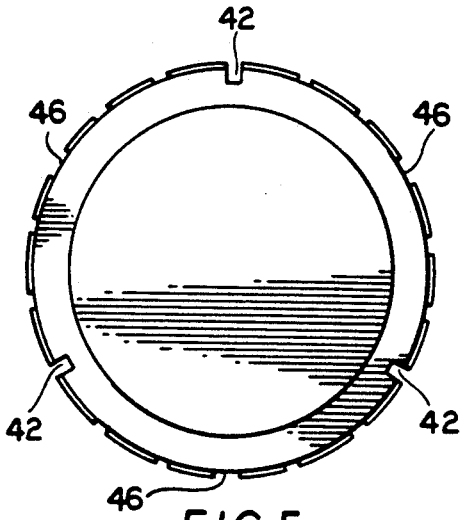
FIG. 5 is a top plan view of the inner latching cap member.
Figure 6:
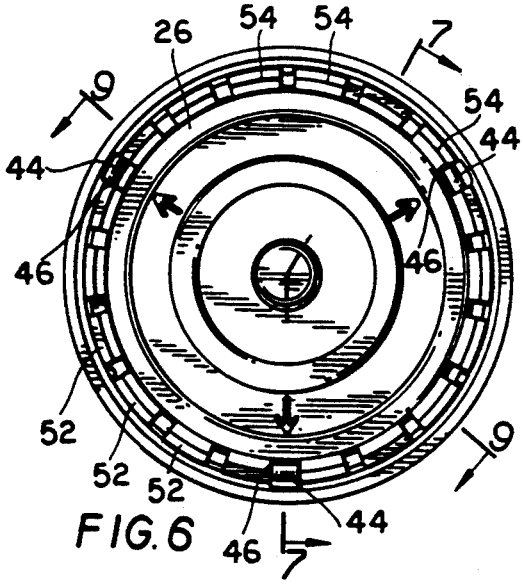
FIG. 6 is a bottom plan view of the outer locking member assembled with the inner latching cap member with the gasket removed showing the alignment of the lugs and cut outs that when aligned permit this assembly.

In the drawings, a releasable, can closure 20 of the present invention includes an outer annular circumferential extending outer locking member 22, an inner latching cap member 24 and an annular sealing gasket 26 each adopted to be coupled with one other to releasably seal a can 28 and its contents once the can has been opened and its contents partly consumed. Currently cans include a top rim 30 with which the closure 20 of the present invention is capable of releasably latching in order to seal the contents of a partly consumed can of beverage.

The outer locking member 22 is constructed with a circumferentially extending annular top 32 defining a circular top opening 34 that permits digital access to the inner latching cap member and a downwardly depending apron 36. The inner face 38 of the apron 36 includes at least one lug 40 and in the specification embodiment three lugs 40 which cooperate in aligning the outer locking member 22 with the inner latching cap member 24 by meshing with the slots 42 in the inner latching cap member 24. The lugs 40 not only provide an aligning function but prevent relative rotation of the outer member 20 relative to the inner latching cap member 24 when the these members are coupled in the closure locked and sealing position as shown in FIG. 11.

The outer locking member 22 is prevented from being raised too far to disassociate the outer locking member 22 from the inner latching cap member 24. In this regard, lugs 44 releasably engage with surfaces 46 of the inner latching cap member 24. This interengagement prevents outer locking member 22 from being inadvertently disassociated from the inner latching cap member 24, but, more importantly, to urge the inner member off the can top rim 30 along with the outer member 22 as it is raised to remove the closure 20 and unseal the can. In this connection, lugs 44 will engage surfaces 46 upon raising vertically the outer locking member 22 and consequently will raise the inner cap member 24 as well.

Figure 7:
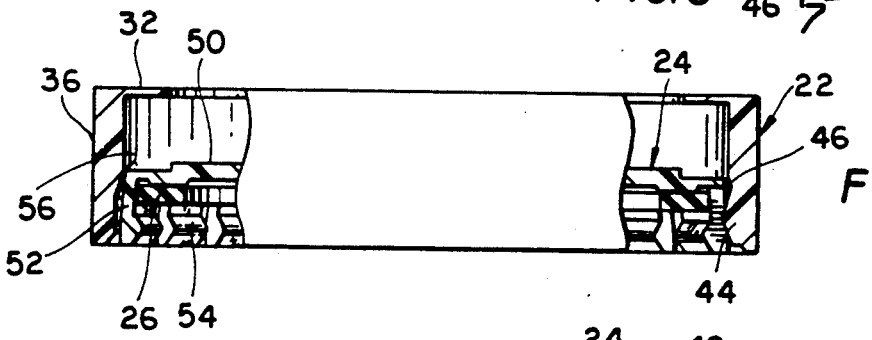
FIG. 7 is a enlarged elevational view of the three components of FIG. 1 assembled an partially in section with the closure ready to be applied to a can; in this position the inner latching cap member is depressed relative to the outer raised locking member.
Figure 8:
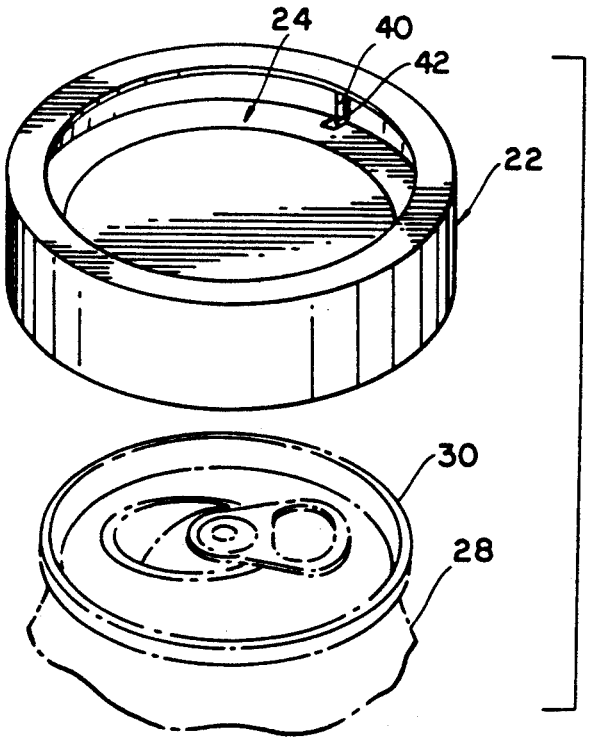
FIG. 8 is a perspective view of the assembled closures about to be applied to a can top shown partly in phantom.
Figure 9:
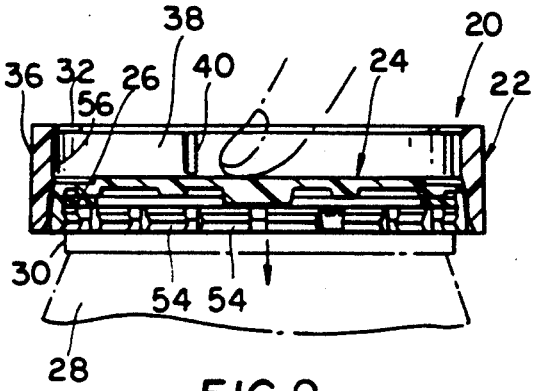
FIG. 9 is a sectional view of the assembled closure with the inner depressed latching cap member about to be latched with the upper rim of the can, with the arrow indicating the force necessary to be applied to latch the inner latching ca member about the can top rim.
Figure 11:
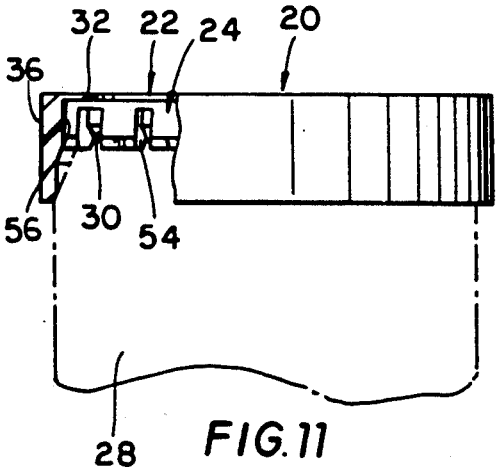
FIG. 11 is a similar elevational view partly in section with the outer locking member lowered to releasably latch the inner latching cap member about the can top rim to seal the can contents.

The inner latching cap member 24 include a top 50 having a raised central disc portion that is flush with the top 32 of the outer locking member 22 when these parts are coupled as shown in FIG. 11. A series of substantially independent downwardly depending spring fingers 52 having inwardly extending lugs 54 which cooperate in maintaining the sealing gasket in place and are designed to ride over and releasably grip the lower surfaces of can top rim 30. This is facilitated by the ability of the fingers 52 to flex outwardly to permit the lugs 54 to ride over the can top rim 30 when the outer locking member 22 is raised relative to the inner depressed latching cap member 24 as shown in FIGS. 7, 8 and 9. When the inner latching cap member 24 is forced downwardly over the can top rim 30 as shown in FIG. 9, the fingers 52 will flex inwardly to secure the lugs 54 about the can top rim 30. The engagement of the lugs 54 about the ca top rim 30 is secured by lowering the outer locking member 22 and permitting the reduced diameter camming surface 56 of the inner face 38 of the locking member to urge or squeeze fingers 52 radially inwardly. The locked position of the closure 20 is shown in FIG. 11.

Figure 10:
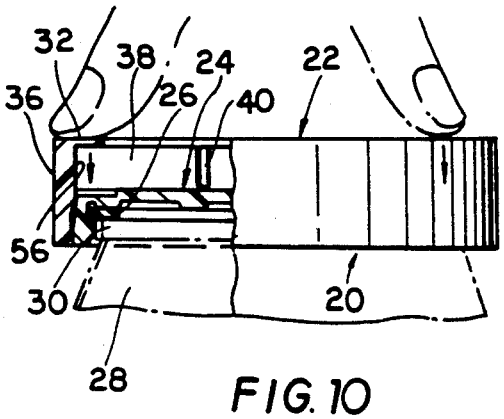
FIG. 10 is an elevational view partly in section showing the inner latching cap member latched or coupled with the can top rim, and with the outer locking member about to be lowered to releasably latch the inner latching cap member and consequently the closure about the can top rim.
Figure 12:
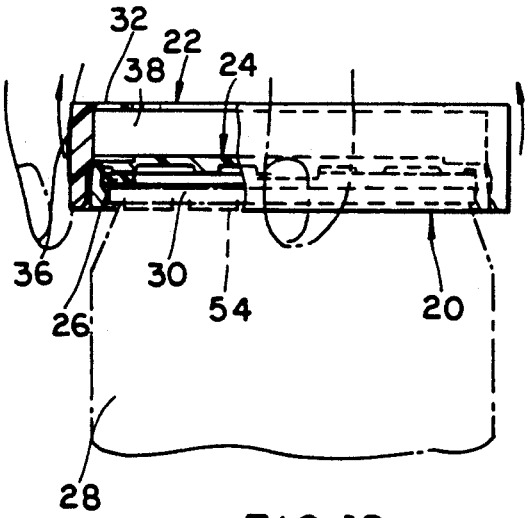
FIG. 12 is similar elevational view partly in section with the outer locking member raised to permit unlatching of the inner latching cap member to enable the removal of the closure from the can top rim.
Figure 13:
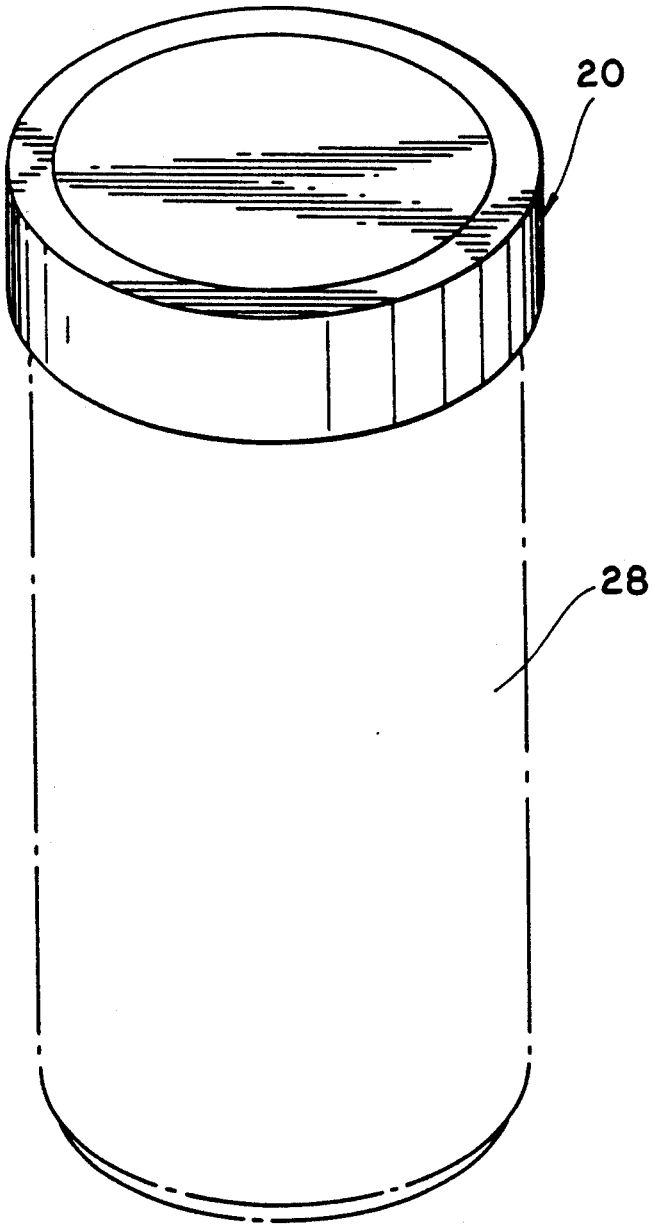
FIG. 13 is a perspective view showing the assembled closure releasably latched and locked to the can top rim to seal the contents of the can.

The utilization and operation of the closure 20 to seal the contents of an opened partially consumed beverage can is shown in FIGS. 9-12. The starting position to initiate the sealing of the can is shown in FIG. 9 with the outer locking member 22 raised relative to the lowered or depressed inner latching cap member 24. The inner latching cap member 24 is digitally forced downwardly. The FIGS. 52 of the inner latching cap member 24 flex outwardly as the lugs 54 ride over the can top rim 30. When the inner latching cap member 24 is fully sealed on the can top the lugs 54 engage the lower face of the can top rim 30 and the gasket 26 is in sealing engagement with the can top rim 30 as shown in FIG. 10. In order to secure or lock this sealing position the outer locking member 22 is digitally forced downwardly the start of which is shown in FIG. 10. As the outer locking member 22 is advanced downwardly the camming face 56 of the inner face 38 of this number 22 urges the fingers 52 radially inwardly to lock the lugs 54 about the can top run 30. The fully locked and sealing position is shown in FIG. 11. In order to remove the closure 20 and permit the remaining contents of the can 28 to be consumed, the outer locking member 22 is raised as shown in FIG. 12. This will permit the fingers 52 to be free to flex outwardly as the outer member 22 is further raised thereby raising the inner latching cap member 24 also due to the engagement of the lugs 44 of the outer member 22 and the surfaces 46 of the inner member 24. The closure 20 is removed in this fashion to permit the can contents to be fully consumed.

Thus, the several aforementioned objects and advantage are most effectively attained. Although a single somewhat preferred embodiment is described and disclosed in detail herein it should be understood that this invention is in no sense limited thereby and its scope is to be determined by that of the appended claim.

I claim:

1. A closure for resealing the partially consumed contents of a can having a vertical axis and a top rim comprising:

an outer vertically and linearly shiftable locking member shiftable axially between an upper position and a lower position and having an inner face and inner circumferentially extending camming means;

an inner vertically and linearly shiftable latching cap member shiftable axially between an upper position and lower position disposed interiorly of the outer locking member having a closed top and adapted to be linearly and vertically depressed and raised relative to said outer locking member, the inner latching cap member having a plurality of downwardly depending fingers that are adapted to flex radially outwardly when the outer locking member is raised vertically relative to the inner latching cap member, radially inwardly extending lugs on the fingers adapted to ride over the can top rim as the inner latching cap member is forced downwardly about the can top to assume a latched position, the inner latching cap member and outer locking member having interengaging surfaces that cause the inner latching cap to be raised vertically when the outer locking member is raised vertically, sealing means associated with the inner latching cap member for engaging with the can top rim to seal the can contents when the inner latching cap member is in the latched position, the closure being placed in a releasable locked sealed position upon vertically depressing the outer locking member relative to the inner latching cap member when it is in the latched position, the vertical depressing of the outer locking member causing the camming means to engage with the fingers to urge then inwardly for releasable locking the lugs about the can top rim, the closure is adapted to be removed from the can top upon raising vertically the outer locking member to permit the inner latching cap member to assume an unlatched position by the fingers flexing outwardly and the lugs disengaging from the can top rim as the inner latching cap member is raised by raising vertically the outer locking member, and guide means comprising vertically extending lugs on said inner face of said outer locking member which engage in slots between pairs of said fingers on said inner latching cap member for linearly and vertically guiding the outer locking member relative to said inner cap member.

2. The closure in accordance with claim 1 wherein rotation preventing means are provided for preventing the outer locking member and inner latching cap member from rotating relative to one another when the outer member is raised and the lower member is raised.

3. The closure in accordance with claim 2 wherein the rotation preventing means includes lugs on the inner face of the outer member and accommodating slots on the inner latching cap member.

4. The closure in accordance with claim 1 wherein raising means are provided for permitting the inner latching cap member to move with the outer locking member when the closure is removed from the can top upon raising of the outer member, the raising means preventing inadvertent disassociation of the outer and inner members.

5. The closure in accordance with claim 4 wherein the raising means includes a plurality of inwardly extending lugs on the inner face of the outer locking member that engage with surfaces of the inner latching cap member when the outer member is raised relative to ,the inner member.

6. The closure in accordance with claim 5 wherein the inner latching cap member is provided with accommodating slots for receiving the lugs on the inner face of the outer member when the inner member is in the unlatched position and the outer member is raised relative to the inner member.

7. The closure in accordance with claim 1 wherein the inner latching cap member has a closed top having a raised central portion, the outer locking member having a top with a central opening for accommodating the raised portion and for being flush therewith when the members are both depressed and the closure is in its locked sealed position, the central opening permitting digital access to the inner latching cap member so that the inner member can be depressed to its latched position.

8. The closure in accordance with claim 1 wherein the sealing means is a annular gasket disposed interiorly of the inner latching cap member between the top of the inner member and the inwardly extending lugs of the fingers.

9. The closure in accordance with claim 1 wherein the inner member, and outer member and sealing means are annularly shaped.

10. The closure in accordance with claim 9 wherein the fingers extend circumferently about and depend downwardly from the top of the inner latching cap member.

* * * * *